US009027779B2

(12) United States Patent
Friedman

(10) Patent No.: US 9,027,779 B2
(45) Date of Patent: May 12, 2015

(54) FRONT EMPTYING TRASH CAN

(71) Applicant: Aaron N Friedman, Waukegan, IL (US)

(72) Inventor: Aaron N Friedman, Waukegan, IL (US)

( * ) Notice: Subject to any disclaimer, the term of this patent is extended or adjusted under 35 U.S.C. 154(b) by 0 days.

(21) Appl. No.: 14/194,810

(22) Filed: Mar. 2, 2014

(65) Prior Publication Data

US 2014/0246439 A1 Sep. 4, 2014

Related U.S. Application Data

(60) Provisional application No. 61/771,887, filed on Mar. 3, 2013.

(51) Int. Cl.
*B65F 1/16* (2006.01)
*B65F 1/06* (2006.01)
*B65F 1/14* (2006.01)

(52) U.S. Cl.
CPC . *B65F 1/06* (2013.01); *B65F 1/068* (2013.01); *B65F 1/163* (2013.01); *B65F 2001/1661* (2013.01); *B65F 2210/148* (2013.01); *Y10S 220/908* (2013.01)

(58) Field of Classification Search
CPC .. B65D 1/1426; B65D 1/1436; B65D 1/0073; B65D 1/06; B65D 1/1415; B65D 1/1421; B65D 1/163; B65D 1/068; B65D 1/63
USPC ..... 220/495.11, 263, 264, 908; 248/101; 232/43.2
See application file for complete search history.

(56) References Cited

U.S. PATENT DOCUMENTS

D99,399 S 4/1936 Karper
D154,377 S 7/1949 Freedman et al.
2,563,456 A * 8/1951 Brownell ..... 220/263
2,644,737 A * 7/1953 Davis ..... 312/270.3
2,946,474 A * 7/1960 Knapp ..... 220/23.87
3,191,960 A * 6/1965 Turner ..... 280/47.19
3,204,866 A * 9/1965 Brighton et al. ..... 232/43.2
3,211,367 A * 10/1965 Jessop ..... 232/43.2
3,226,015 A * 12/1965 Manfredonia ..... 232/43.2
3,261,545 A * 7/1966 Frazier ..... 232/43.2
3,314,632 A * 4/1967 Freuler ..... 248/101
3,556,395 A * 1/1971 Herman ..... 232/43.2

(Continued)

FOREIGN PATENT DOCUMENTS

EP 1816090 A 8/2007
GB 2493016 A 1/2013

OTHER PUBLICATIONS

Rubbermaid Trash Can with Retainer Bands http://www.amazonsupply.com/rubbermaid-commercial-defenders-retainer-imprint/dp/B007OAXO16.

*Primary Examiner* — Anthony Stashick
*Assistant Examiner* — Ernesto Grano
(74) *Attorney, Agent, or Firm* — Lesley A. Wallerstein, LLC

(57) ABSTRACT

A trash can for hanging and retaining standard kitchen trash bags in a sanitary and energy efficient manner. Novel trash bag support brackets are suspended spatially within the trash can to allow a user to stretch the mouth of a trash bag thereabout without touching any other surface. The trash bag opens from the front, allowing a user to hang the trash bag without bending or stooping. Foot pedals control three different lid positions. A combination false bottom/catch pan tilts backwards to collect and contain any solid or liquid waste. An integral pedal-to-lid linkage shield affixed to the back of the false floor doubles as a handle to lift the false bottom/catch pan out from the trash can for cleaning.

16 Claims, 14 Drawing Sheets

(56) References Cited

U.S. PATENT DOCUMENTS

| | | | | |
|---|---|---|---|---|
| 4,753,367 | A | 6/1988 | Miller et al. | |
| 4,953,744 | A * | 9/1990 | Koyama | 220/495.11 |
| 4,972,966 | A * | 11/1990 | Craft, Jr. | 220/264 |
| 5,031,793 | A * | 7/1991 | Chen et al. | 220/495.07 |
| 5,269,435 | A | 12/1993 | Hallock, III | |
| 5,372,271 | A * | 12/1994 | Miller et al. | 220/263 |
| 5,884,556 | A | 3/1999 | Klepacki et al. | |
| 5,901,872 | A * | 5/1999 | Zollinhofer et al. | 220/573 |
| 5,984,134 | A * | 11/1999 | Mario | 220/661 |
| 6,000,569 | A * | 12/1999 | Liu | 220/263 |
| 6,024,238 | A | 2/2000 | Jaros | |
| D429,399 | S | 8/2000 | Swanson | |
| 6,179,151 | B1 * | 1/2001 | Radvansky et al. | 220/495.06 |
| 6,276,553 | B1 * | 8/2001 | Vulcano | 220/495.06 |
| 7,530,578 | B2 * | 5/2009 | Niemeyer et al. | 280/47.26 |
| 7,611,009 | B2 * | 11/2009 | Youngs | 206/81 |
| 7,624,915 | B2 * | 12/2009 | Dembowiak et al. | 232/43.2 |
| 7,654,443 | B1 * | 2/2010 | Fuller et al. | 232/43.2 |
| D615,270 | S | 5/2010 | Yang et al. | |
| 8,056,759 | B2 | 11/2011 | Spence | |
| 8,136,688 | B2 * | 3/2012 | Lee et al. | 220/262 |
| 8,235,237 | B1 * | 8/2012 | Stravitz | 220/264 |
| 8,678,219 | B1 * | 3/2014 | Wang et al. | 220/211 |
| 2003/0230576 | A1 * | 12/2003 | Lin | 220/263 |
| 2006/0213910 | A1 * | 9/2006 | Yang et al. | 220/264 |
| 2006/0278643 | A1 * | 12/2006 | Chiou | 220/263 |
| 2008/0245794 | A1 | 10/2008 | Escobar et al. | |
| 2009/0079306 | A1 * | 3/2009 | Lager | 312/293.2 |
| 2010/0084235 | A1 * | 4/2010 | Lu | 188/280 |
| 2011/0056952 | A1 * | 3/2011 | Borowski et al. | 220/495.06 |
| 2011/0272407 | A1 * | 11/2011 | Golcheh | 220/495.06 |
| 2012/0037637 | A1 * | 2/2012 | Beyda et al. | 220/495.11 |
| 2013/0105486 | A1 * | 5/2013 | Mashburn et al. | 220/495.06 |
| 2014/0246432 | A1 * | 9/2014 | Yang et al. | 220/262 |

* cited by examiner

FRONT EMPTYING TRASH CAN

CROSS-REFERENCE TO RELATED APPLICATION

This application claims priority to U.S. Provisional Patent Application 61/771,887, filed Mar. 3, 2013.

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to trash cans, in particular, a more sanitary, universal and convenient way of installing and removing trash bags within trash cans.

BACKGROUND OF THE INVENTION

The known method of removing a full trash bag from a container via lifting the full trash bag up and over the container is a hassle. It is unsanitary to the touch and difficult to overcome the suction created between the bag and the can.

Some trash cans require a user to use their hands in order to open, close or otherwise position the lid. This causes a user to touch the bag or decaying trash. It is also inconvenient to handle the lid in any way at all, especially while a user's hands are already occupied with what is to be put into the trash can at the time.

Prior art trash cans have problems with their foot pedals as well. In some models, a user steps on a foot pedal to open the lid. With the lid held open, while keeping the foot on the foot pedal he reaches with the hand, and pushes a button near decomposing trash. Other models have eliminated the button but instead require a user to use their hands to position the lid, again in close proximity to decaying garbage.

Many prior art trash cans are not optimally dimensioned to hold standard trash bags. To compensate for this, a user ties excess bag in a knot to keep the bag from slipping. Tying these knots is inconvenient and unsanitary. Other methods of solving this problem include the use of clips or other securing means. Clips are inconvenient as well, and can tear the trash bag.

Yet other trash can models are designed with gripping holes suggesting where to gather and tuck excess trash bag material. Yet this solution too presents problems of its own. It takes time, requires a user to touch the inner container and if the holes have pointed gripping means, these may very well tear the trash bag.

Some trash cans consist of two containers, one nested within the other. The inner container actually holds a trash bag, and the outer container conceals it. Even though this is esthetically more appealing, this system still does not relieve a user from having to lift a full trash bag up and over the container upon attempting removal of the full trash bag from the trash can. With these models as well there is the problem of suction created by lifting up the full trash bag from its enclosure. The dimensions of the inner container are generally incongruent with those of a standard 13 gallon tall kitchen trash bag thus not allowing an adequate fit of a standard 13 gallon tall kitchen trash bag.

For example, users of some of these trash cans are encouraged to use costly custom trash bags made by, and specifically for use with, the particular make or model of that trash can. This is because the inner container is not appropriately dimensioned for securing a standard 13 gallon tall kitchen trash bag. Standard 13 gallon kitchen trash bags are too large, and will not stay secured to the rim of the inner container. The bag will slip into the inner container, spilling into the trash can.

A front emptying trash can has been created to solve these, and other problems. This trash can opens from the front, revealing the trash bag inside. A user does not have to lift the bag up and out, but rather, pulls it toward him in one easy motion. Because the trash can is open, there is no suction. After removing the top portion of trash bag from the bag holder bracket, a user ties the trash bag as normal. This trash can accommodates bags of all sizes, with drawstring closures, flaps or not.

This trash can also solves the problem of a user having to hold the can open with one hand and still add trash. This trash can has a lid which can be raised and lowered via a recessed foot pedal. Recessing the foot pedal allows a user to remove a full trash bag via the front opening door, without any interference of the foot pedal.

This trash can solves the problem of trash leaking out of, or missing, the bag. A built-in, removable false bottom is angled to direct such errant debris toward a lower back of the trash can. A rigid handle, which doubles as a foot pedal linkage shield, connects to a rear lower edge of the false bottom and lies against a rear inner surface of the trash can. A user can use this handle to thus lift the false bottom upward and outward to remove waste or clean the bottom, then lower the bottom back down and in when finished.

This trash can is dimensionally compatible with all standard 13 gallon tall kitchen trash bags. Custom made-to-fit trash bags are generally unnecessary. A user is able to achieve a snug and secure fit using their choice of any standard 13 gallon tall kitchen trash bag without pinched fingers, scraped knuckles, or touching contaminated parts. The trash can eliminates the need to tie knots, engage clips, tuck excess bag material while loading or removing the bag.

BRIEF SUMMARY OF THE INVENTION

This front emptying garbage can is a hollow rectangular prism generally comprised of a hinged front door, a back shell, a left shell, a right shell, a base and a hinged lid. This garbage can comprises five inventive features: universal, sanitary, pinchless bag support bracket, removable false bottom/catch pan, substantially foot-operated lid stay mechanism, soft closing lid, and latching front door.

Universal, Sanitary, Pinchless Trash Bag Support Bracket

An inner trash bag support bracket system affixed to the upper inner surface of two opposing side shells allows a user to suspend any standard kitchen garbage bag without pinching his fingers and without touching any part of the shell. The trash bag support bracket system comprises a right and a left bag support tracks mounted to corresponding sides of an inner surface of the shell, a right and a left bag slide guide which slide vertically up and down the corresponding bag support tracks, a top and a bottom slide stop mounted to each of the bag support tracks, and a generally C shaped bag support bracket. Each bag support track has a top and a bottom slide stop to prevent a user from removing the corresponding slide guides from the tracks.

The C shaped bag support bracket comprises a left arm, a right arm, each connected to a central piece. The C shaped bag support bracket has an upper edge and a lower edge, defining a uniform height along its length. The lower edges of the right and the left arms of the C shaped bag support bracket are affixed to a corresponding bag support track. The upper edges of the right and the left arms of the bag support bracket have cutouts suggesting where a user should optimally place his fingers or hands. In practice, a user places his fingers or hands in one or both cutouts and lifts the bag support bracket. Because the bag support bracket is fixedly attached to the bag slide guide, pulling up on the bag support bracket also lifts the bag slide guide along its corresponding track, but only as far as the upper slide stop will allow. This lifts the entire bag support bracket above the upper edge of the shell. A user is now ready to hang a new trash bag.

To hang a new trash bag, a user opens the front door and lifts the bag support bracket above the upper edge of the shell. He positions an unstretched trash bag inside the space defined by the C of the bag support bracket, with the trash bag opening facing upward. He pulls the opening of the trash bag above the bag support bracket, then folds it down over the upper edge of the bag support bracket.

It is important that the bag support bracket is C shaped and open facing a user, with the center of the C facing the back inner shell and the left and the right arms facing forward, toward a user. This way, a user can hang a trash bag in one fluid forward motion. There is no bending or stooping required. The bracket is specifically dimensioned to create sufficient tension in the front of the bag where a front bracket piece might otherwise be, so that the opening of the trash bag hangs level and generally parallel to the true floor. The three edges of the bracket hold the front opening edge of the trash bag taut until a user chooses to remove it for disposal. The bag is held in place without a front bracket piece, without clips, drawstrings, slots or self-knots. After thus securing the bag on the bracket, a user pushes the bracket back down into the can.

Removable False Bottom/Catch Pan

Yet another advantage of this trash can is its removable false bottom/catch pan. The false bottom rests upon and over the base. The false bottom tilts backward to catch any loose solid or liquid waste and directs it toward the inner back shell of the can, much like a dustpan. This false bottom is not fixedly connected to either the base or the sidewalls, but rather rests on shelf-like supports affixed to the left, the right and back inner shell, just above the base. A rigid pedal-lid linkage shield is coupled to the lower rear edge of the false bottom/catch pan and doubles as a handle. This handle rises vertically along the rear inner surface of the back inner shell, generally parallel to the height of the trash can. When a trash bag is suspended in the can, a user cannot access either the handle or the lid linkage; they are covered by the bag. After the trash bag is removed, a user can lift and remove the false bottom with the clean handle, with a minimum of effort. The bottom can be replaced with equal ease.

Foot-Operated Lid Opening and Stabilizing System

Another advantage of this garbage can design is its totally foot-operated lid stay. This way, a user can open the can, lock it in an open position and later close it, all without touching the can with his hands. A recessed foot pedal coupled to the back of the lid lifts and lowers the lid via a rigid linkage. The pedal has an integral slot configured to slide over a flexible latch. The latch can take any number of forms. In a preferred embodiment and illustrated here, the latch is a bent flat leaf spring. In an alternative embodiment, the latch has a bulbous protrusion. In yet other alternative embodiments, the latch can be a grab catch. In these or any other embodiment, a user is able to use his foot to engage the latch into one of any of three positions: quick open, stabilized open and closed.

In a preferred embodiment, to quick open the lid, a user simply steps on the front of the pedal. The back of the pedal is affixed to a thin and rigid linkage. The pedal pivots about a horizontal axis, so stepping lightly on the pedal urges the linkage upward and the lid open. Stepping lightly on the pedal does not engage the latch. From a quick open, a user simply releases his foot and the lid will fall by gravity. To stabilize the lid in an open position, a user must step down harder. Regardless of the latch mechanism, stepping harder on the pedal advances the pedal notch over the latch sufficiently far to engage it. To close the lid from the stabilized open position, a user must with his foot disengage the latch. In a preferred embodiment, a user pulls the latch toward him, but this technique will vary with the particular latch mechanism selected.

Foot-Operated Lid Closing Damper

The foot-operated lid stay mechanism is designed to close softly and gently. The foot pedal pivots about a rigid shaft. This shaft, in turn, is coupled to at least one unidirectional rotational viscous damper. Releasing the foot pedal rotates the shaft, which in turn engages the damper. Fluid in the damper retards this rotational motion. The rotational viscous damper or dampers engage(s) only when the lid comes down. There is no dampening effect when the lid is being opened.

Latching Front Door

In a preferred embodiment, the front door opens and closes with a latch operable and accessible from the right or left outer shell. If the latch protrudes from the surface of the shell, a user need not touch the shell with his hands.

REFERENCE NUMBERS

Figure 1:
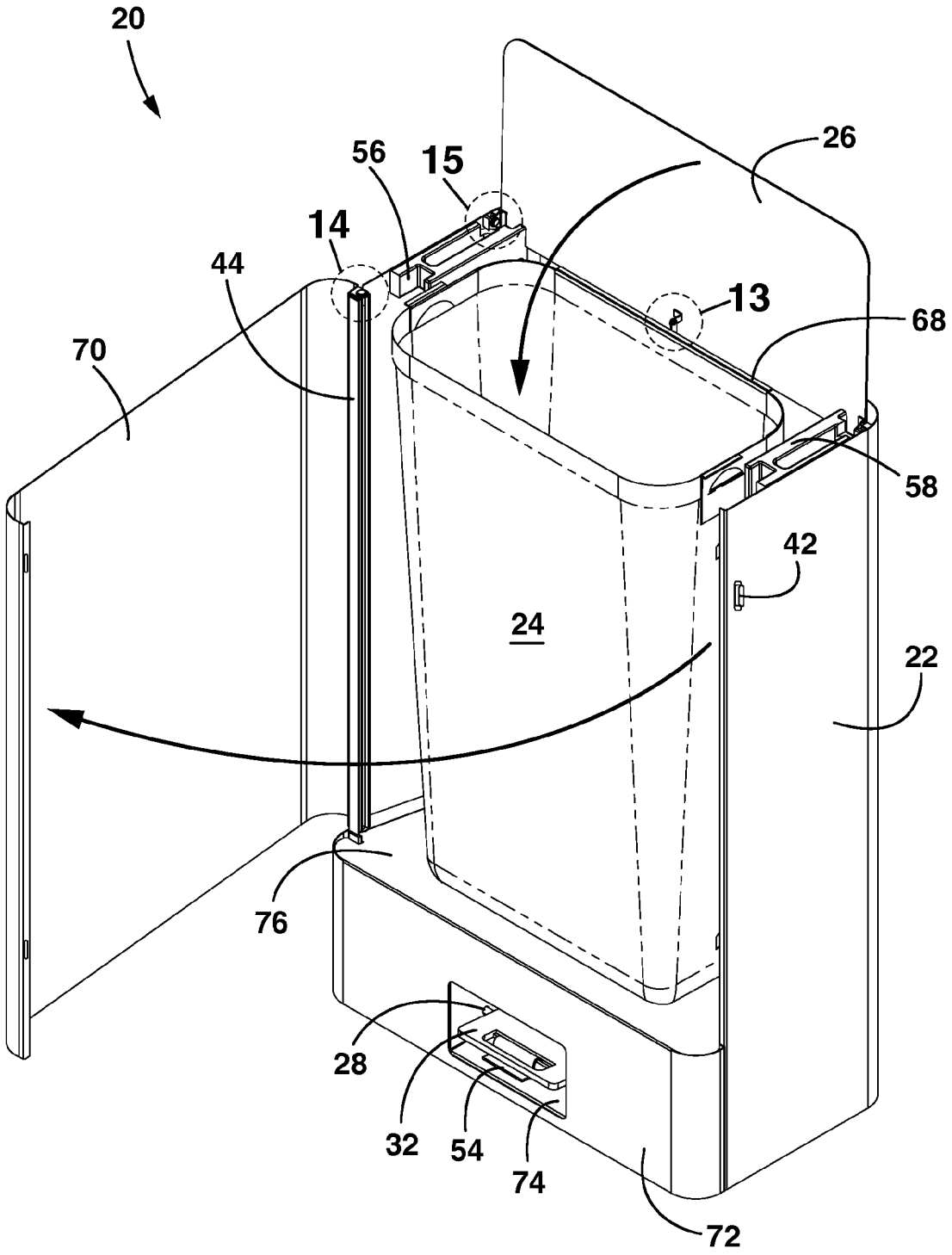
FIG. 1 is a perspective view of the front emptying trash can.

20 front emptying trash can
22 shell
24 trash bag
26 lid
28 axle
30 linkage shield hooks
32 foot pedal
34 anchor
36 linkage
38 rotational damper
40 damper bracket
42 master assembly latch
44 door hinge block
46 lid pivot
48 lid pivot bracket
50 lid pivot pin
52 linkage shield
54 pedal locking latch
56 bag support track left
58 bag support track right
60 latch slide top hook
62 latch slide bottom hook
64 bag slide guide right
66 bag slide guide left
68 bag support bracket
70 door
72 base
74 pedal housing
76 false bottom/catch pan
78 false bottom/catch pan angle support
80 door hinge pin
82 slide stop

DETAILED DESCRIPTION OF THE INVENTION

FIG. 1 shows a perspective view of a preferred embodiment of a front emptying trash can 20. The body of the trash can is defined by an outer shell 22, a hinged door 70, a pivoting lid 26 and a base 72. The outer shell 22 has an inner surface to which is affixed cooperating elements to be described in more detail below. In a preferred embodiment, the outer shell has a right and a left side, defining a generally rectangular prism and creating a generally rectangular footprint. However, trapezoidal, square or other shaped prisms can be used and still fit within the scope of this invention. The corners of the prism can be rounded, as shown, or sharp. Preferably the outer shell, door, lid and base are formed from sheets of stainless steel, but other metals and other materials are also contemplated.

Note the left 56 and right 58 bag support tracks mounted on opposite sides of an uppermost inner surface of the shell. A generally C shaped bag support bracket 68 has left and right arms, each of these arms slides up and down the corresponding bag support track via left 66 and right 64 bag slide guides (not shown in this view). A rear, left and right perimeter of the opening of a standard 13 gallon kitchen trash bag 24 are folded over and supported by the center and the arms of the C. The bracket is specifically dimensioned to hold taut the front perimeter of the trash bag without support and without sagging. This unique bracket design stretches and holds the bag open until it is full.

Figure 11:
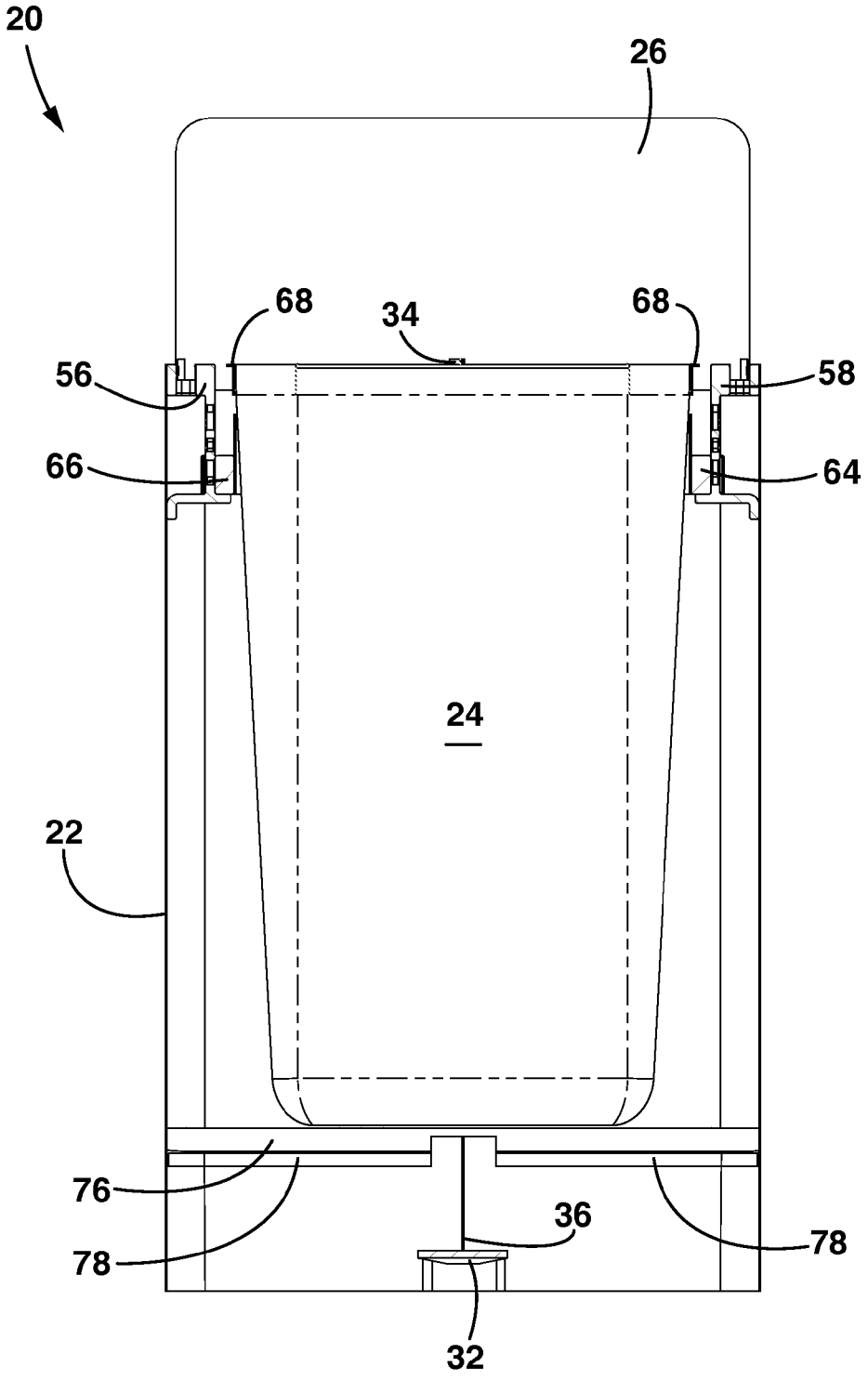
FIG. 11 is a section view taken from FIG. 5, along section line 11

The bag support bracket 68 is not attached to the upper inner rear surface of the outer shell 22. Rather, it slides freely up and down along bag support tracks 56 and 58 mounted to the left and right inner shells. There is space between the shells where tracks 56 and 58 are mounted, and the actual surface against which bracket 68 slides. By moving the bag support bracket up and down, neither a user nor the trash bag need touch the inner surface of the shell. This is seen more clearly in FIG. 11. This space is necessary to allow the bag support bracket 68 to slide up and down without touching the inner shell. It also allows a user to access the bag support system without touching the inner shell. A user manually lifts the bracket to an upper point to hang or remove a trash bag. Notches are cut out of an upper edge of both the right and the left arms of bag support bracket 68 to suggest where a user should place his fingers or hands. The lower front left and right arms of the bag support bracket 68 are affixed to left 66 and right 64 bag slide guides, respectively, so that lifting the bracket 68 also lifts the bag slide guides along the bag support tracks. The bag slide guides fit corresponding bag support tracks closely enough so that the bag support bracket is retained in a desired position by friction. Upper and lower slide stops extend from the bag support tracks 56 and 58 and prevent a user from pulling the bag support bracket completely off those tracks.

Figure 12:
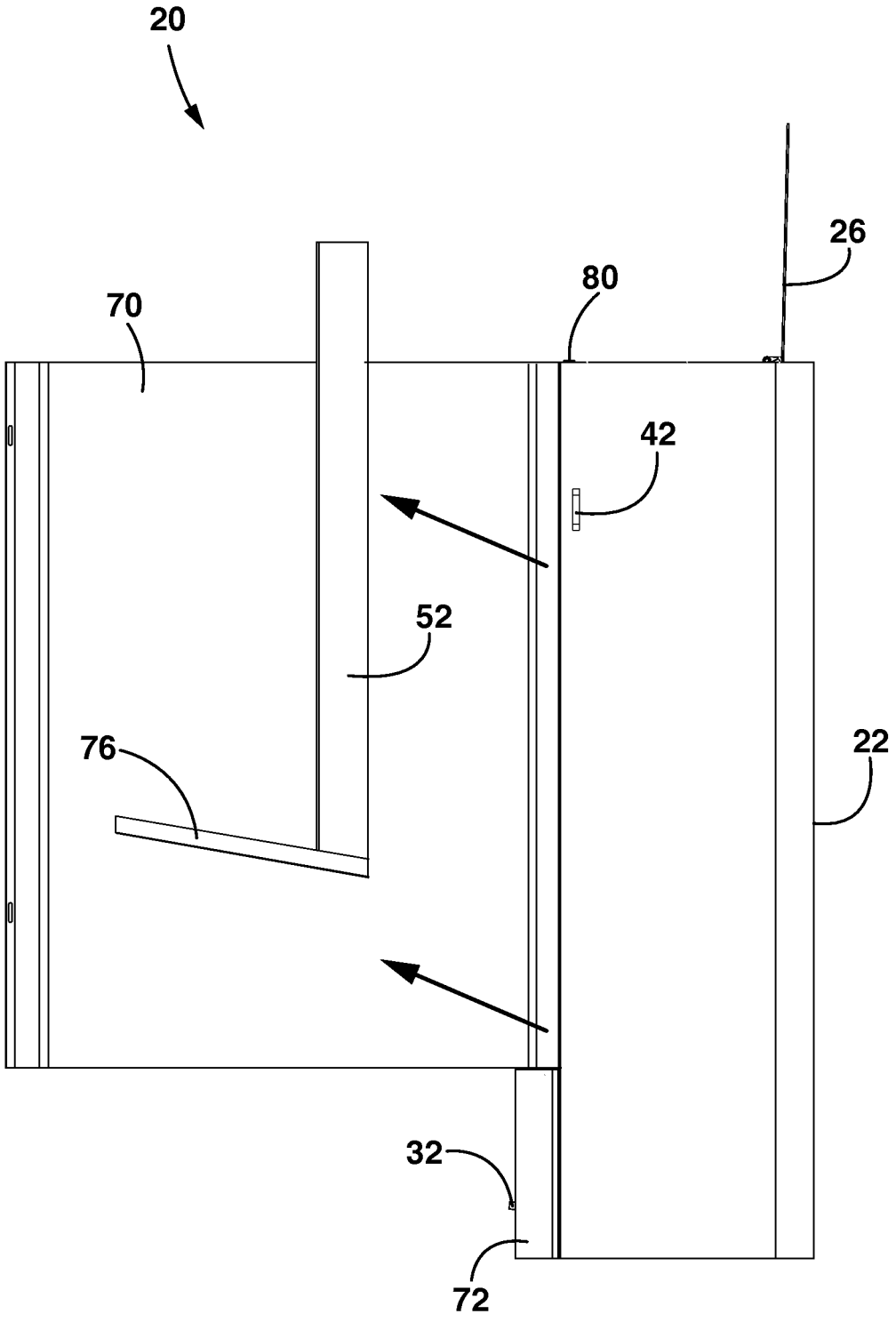
FIG. 12 is a right side view like FIG. 5 with the base removed.
Figure 13:
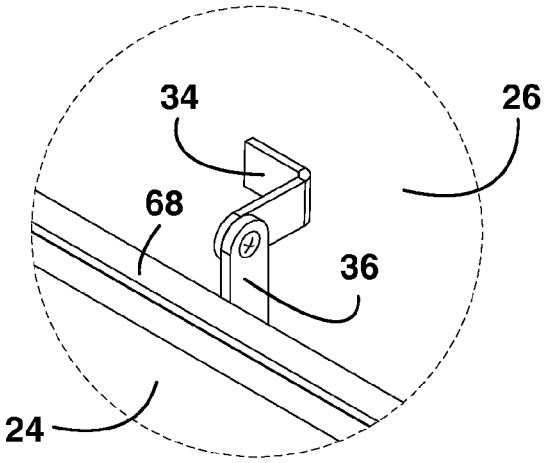
FIG. 13 is a detail view taken from FIG. 1.
Figure 14:
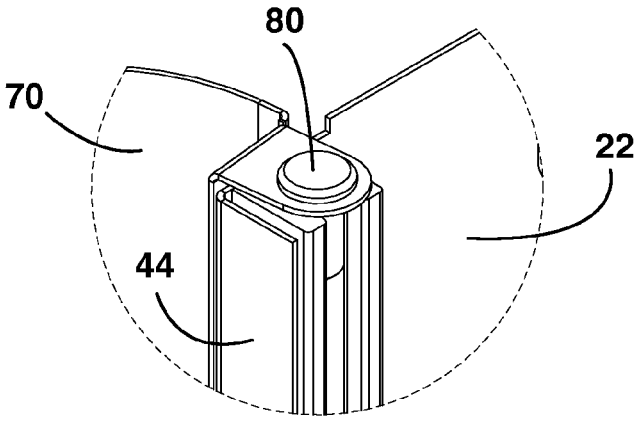
FIG. 14 is a detail view taken from FIG. 1.
Figure 16:
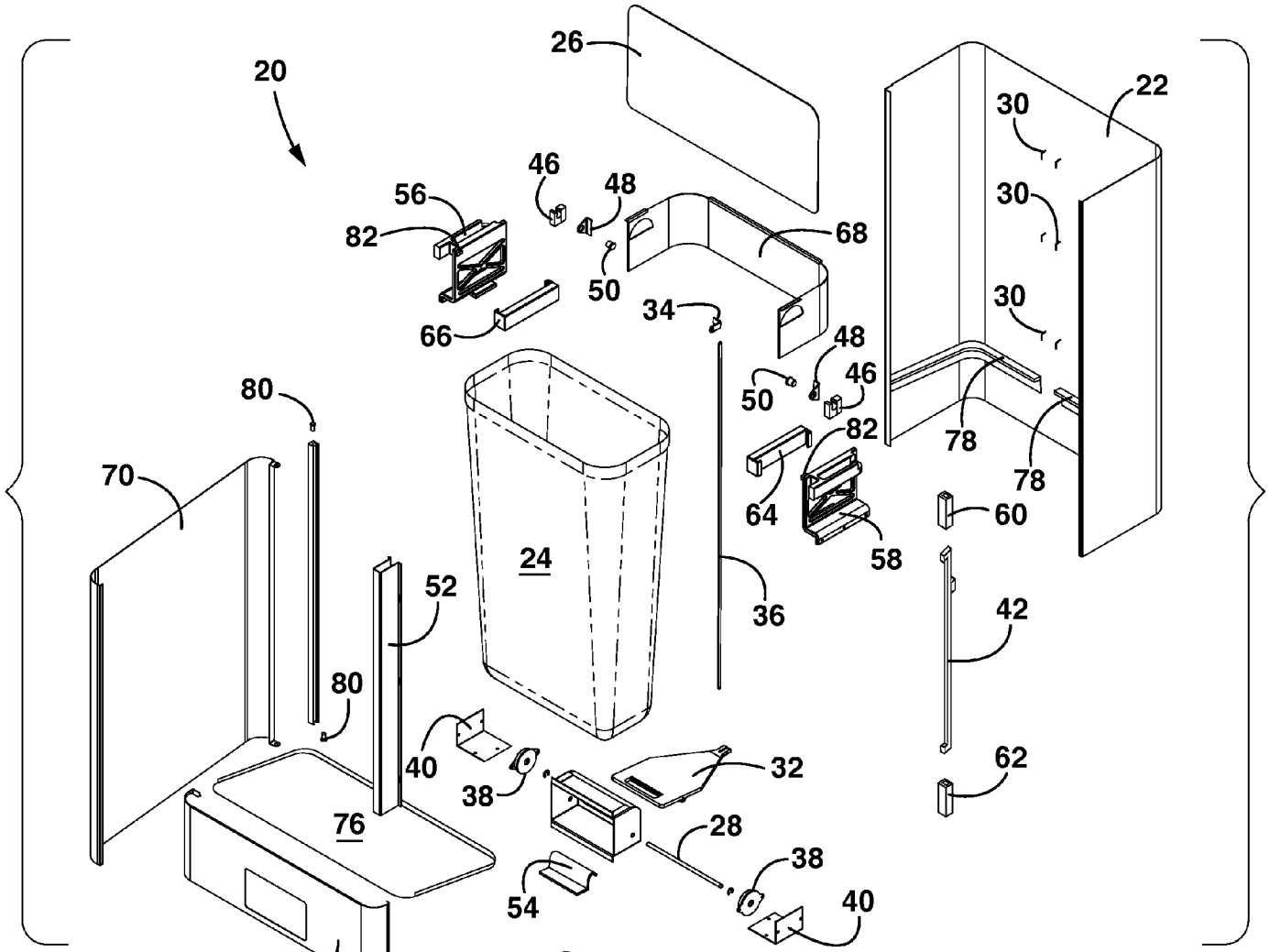
FIG. 16 is an exploded view of FIG. 1.

Mounted to the rear inner surface of the outer shell, and shown in greater detail in FIGS. 12-14 are the lid lifting linkage 36, linkage shield 52 and shield hooks 30. The very top of the linkage and its anchor 34 to the lid 26 are seen at circle 13. The linkage and its protective shield run down the center back of the inner surface of the trash can. The linkage shield at its bottom end is mounted permanently and flush to the catch pan/false bottom 76. The catch pan/false bottom has raised edges around its left, back and right edges, much like a shallow dustpan. This detail can be seen more clearly in the exploded view FIG. 16. These raised edges help contain solid and liquid debris. Using the linkage shield as a handle in this way, a user can lift and remove the catch pan/false bottom for cleaning. Linkage shield hooks 30 affixed to the inner surface of the outer shell retain and store the shield against the inner surface when not in use.

False bottom/catch pan 76 rests on generally linear angle supports 78 (shown in greater detail on FIG. 8) mounted to all inner surfaces of the shell, except the door. Supports 78 are affixed just above the base and protrude toward the center of the trash can. Side supports are angled toward the base. Rear supports run generally parallel to the true floor.

Base 72 has a recess defining the pedal housing 74. Within this recess is a substantially flat foot pedal 32 mounted pivotally about a central axle 28. Pedal 32 controls a substantially foot-operated lid open, stabilizing and closing mechanism. In a preferred embodiment, pedal 32 has an integral slot (not numbered) parallel to the front and back of the trash can. This slot cooperates with a pedal locking spring latch 54 mounted on the floor of housing 74 to open and close the lid. This latch has a width and stands just acute to perpendicular to the housing floor and curves back around itself, defining a top and ending at a blind flat edge. In cross section (FIG. 8) latch 54 resembles a candy cane tilted slightly toward the front of the can. The slot is dimensioned to be just slightly wider and longer than the latch. A rigid lid lifting linkage 36 connects the rear most edge of pedal 32 with the rear, central, lower edge of lid 26 and is shown in more detail in FIG. 7.

To open the lid from a closed position, a user steps down on the portion of the foot pedal in front of the slot. This nudges the pedal over the curved top of the latch and urges the rear most edge of pedal 32 upward, raising linkage 36 and popping open the lid. To stabilize the lid in an open position, a user continues to press the pedal over the latch until the top surface of the pedal has completely cleared the blind flat edge. This motion pulls the latch slightly forward and down toward a user. When a user releases his foot, the latch, being a spring, returns to its original position. The pedal wants to move upward to its original, resting position, but now is blocked by the flat edge of the latch. It cannot move further upward, which would otherwise allow the lid to fall. As long as the latch is engaged, the lid stays open, allowing a user to load trash into the bag for an extended period. To close the lid, a user with his foot pushes the latch away from him, clearing the edge of the latch and freeing the pedal to rise. The latch returns to its resting position until later use. There is an associated lid lowering dampening means, not shown in this view. This damper allows the lid to close slowly and noiselessly.

In an alternative embodiment, not shown, a grab catch latch substitutes for the spring latch. In this embodiment a strike plate is mounted onto the rear, upward facing surface of foot pedal 32. The strike plate can be mounted to the right or the left rear upward surface, as long as it does not contact the linkage. The male portion of the strike plate faces upward, toward the lid. The female, catch portion of the latch is mounted directly against the lower, inner shell. In practice, a user steps on the pedal, which lifts linkage 36 and lid 26. In this embodiment, the upward motion of back edge of foot pedal 32 urges the male strike plate toward and into the female catch. This locks the lid in an upward position. Stepping harder onto pedal 32 releases the grab catch and returns the lid to its original, closed position.

Figure 5:
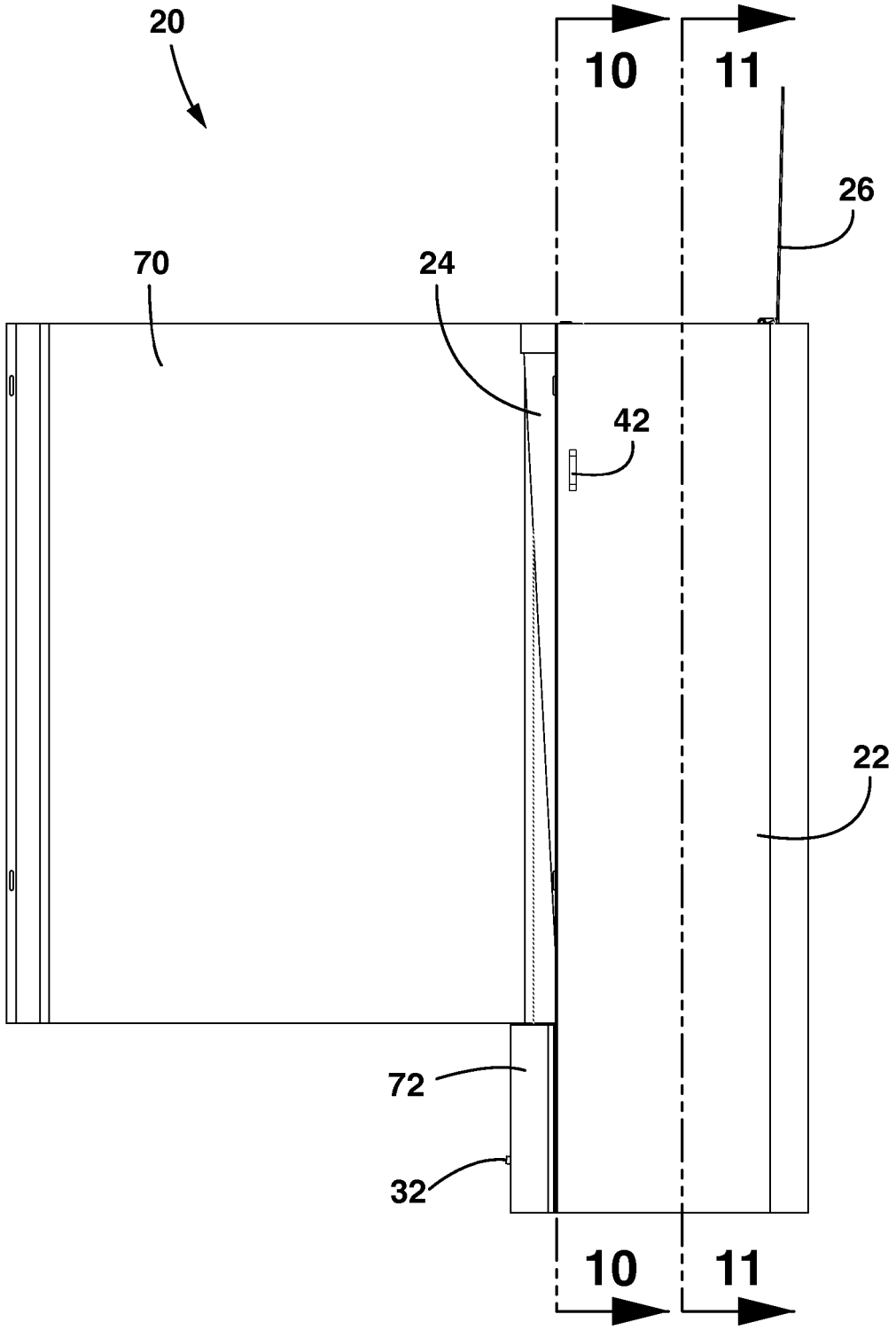
FIG. 5 is a right side view thereof.
Figure 15:
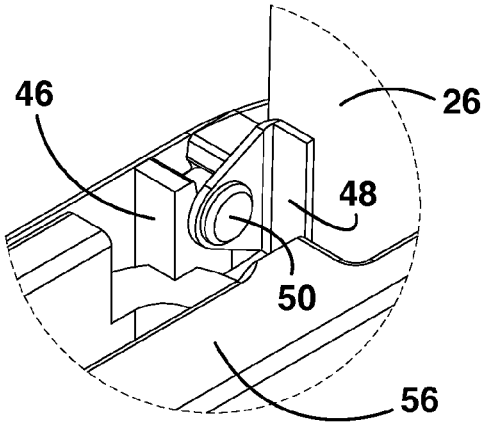
FIG. 15 is a detail view taken from FIG. 1.

Lid 26 pivots open and closed at pivot pin 50, shown in more detail in FIG. 15. Door 70 has a right and a left edge. In this view, the edges are rounded, but they may also be sharp. The left edge of the door is attached to the left outer shell with hinge block 44. The hinge is shown on the left, although this can certainly be reversed to be on the right. This joint is shown in more detail in FIG. 14. Master assembly latch 42 on the non-hinged (in this view, right) side of the outer shell cooperates with holes on the right edge of the door to lock and unlock the door. The holes can be seen again with the door open at FIG. 5.

Figure 2:
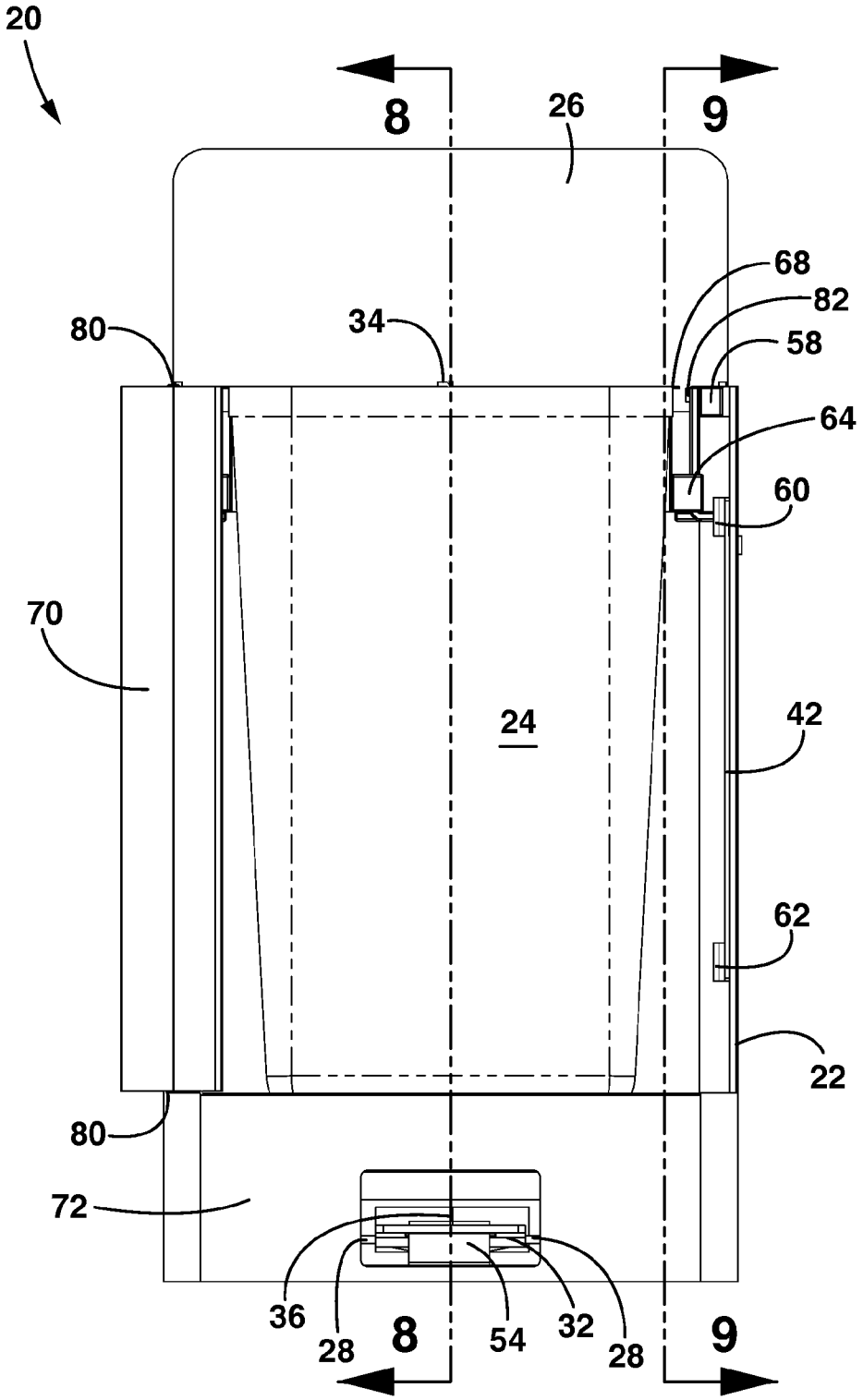
FIG. 2 is a front view thereof.
Figure 3:
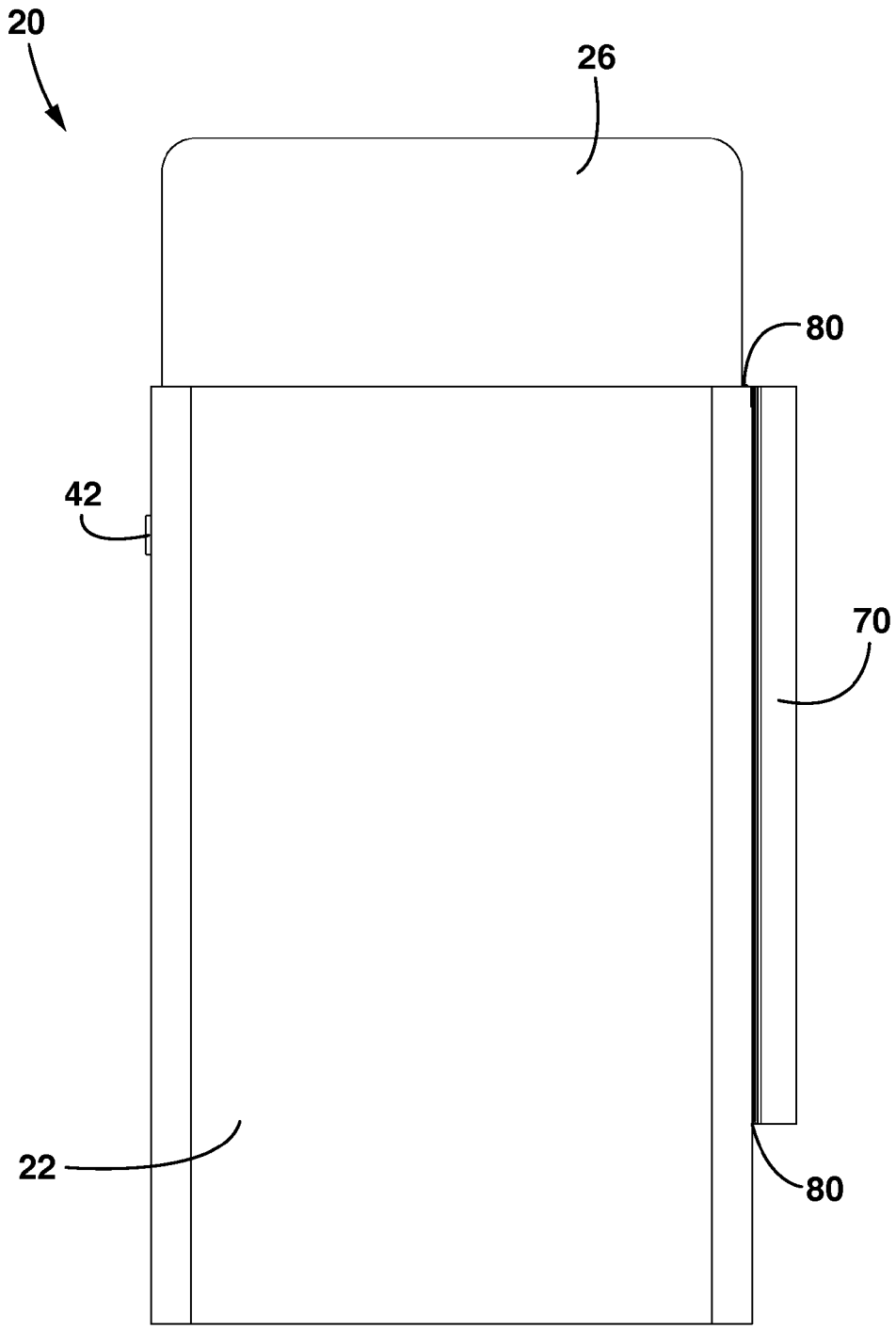
FIG. 3 is a back view thereof.
Figure 4:
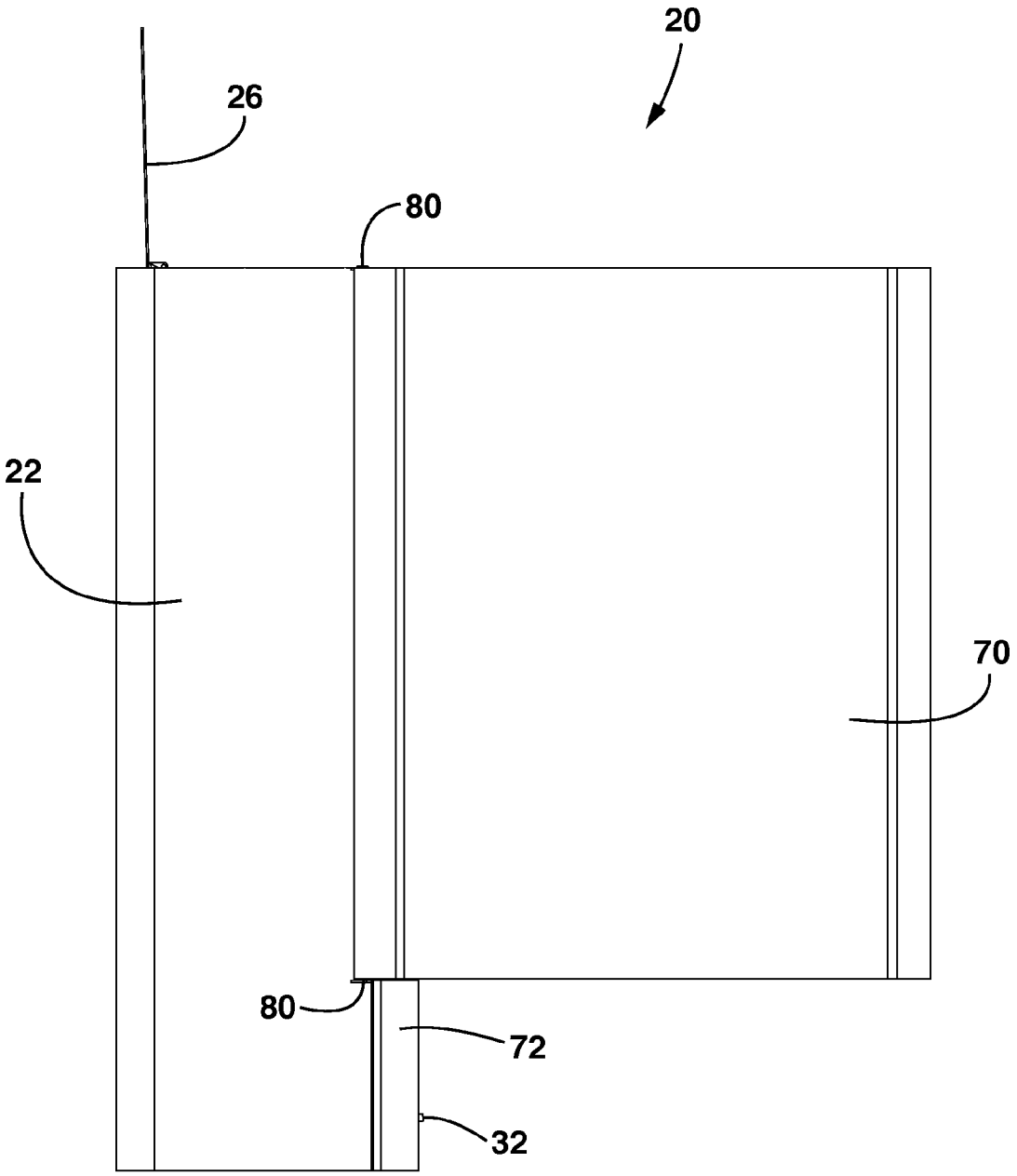
FIG. 4 is a left side view thereof.

FIG. 2 shows a front perspective of the inventive trash can, with the door open. From this point of view, one can see details of the master assembly latch and the bag support-bag support track mechanism. The master assembly latch comprises a vertically oriented latch slide, with a top 60 and bottom 62 hook, controlled by an integral, outward facing knob, not numbered but shown in side perspective most clearly on FIGS. 1 and 3. The top and bottom hook engage corresponding holes in the edge of the door to lock. Sliding the hook up disengages simultaneously both hooks from their respective holes, releasing the door. Closing the door again toward the right side pushes the hooks back into their holes, locking the door.

Oriented posterior to the top hook 60 is a front view of the bag support-bag support track mechanism. For clarity, only the right side is shown. Here, bag support track 58 is affixed to the upper right inner side of the shell. Bag support bracket 68 extends downward and is fixedly coupled at its lower edge to bag slide guide 64. The bag slide guide 64 slides up and down within and along bag support track 58. There is enough clearance between the guide and the track to allow a sliding motion, but close enough to provide friction to hold the guide in a desired vertical position. This enables a user to move the bag support bracket upward, leave it there long enough to hang a new trash bag and then push the bracket down. Extending outward from track 58 are an upper and a lower slide stop (not numbered). These slide stops prevent a user from pushing or pulling the bag slide guide off its track.

Figure 6:
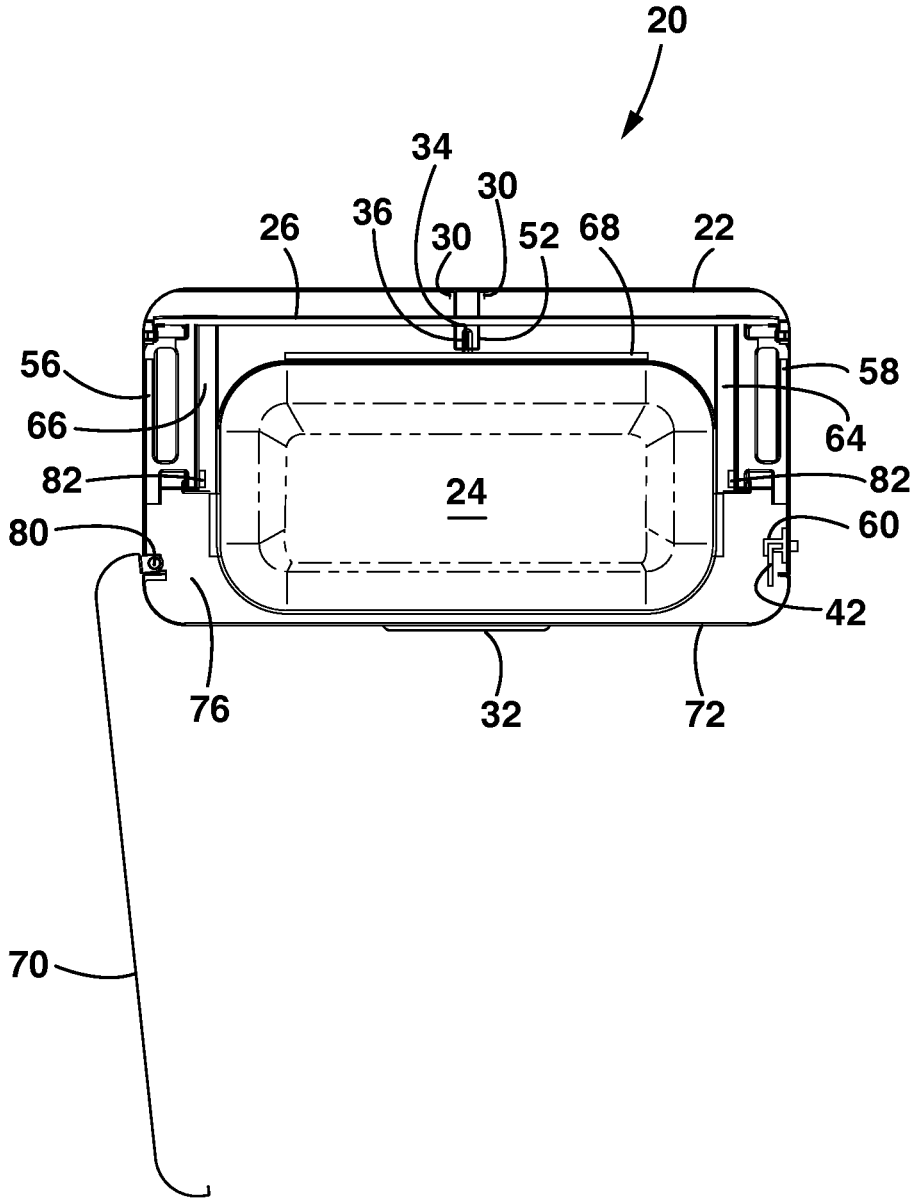
FIG. 6 is a top view thereof.

FIG. 6 shows the bag support system and lid lifting linkage from the top. The bag support system suspends the trash bag anterior to the lid lifting linkage. This separates the bag changing functions separate from the lid lifting functions. The trash bag is suspended in the space defined by the shell. The bag does not touch any part of lid lifting linkage or the inner surface of the shell.

Bag support tracks 56 and 58 are fixedly mounted to two opposite upper edges of the inner surface of the shell. Bag support tracks can be molded or shaped from metal or thermoplastic, although other rigid, lightweight and solid materials would also be suitable. Note upper slide stops 82 protruding from the bag support tracks toward the center space of the can. These prevent a user from pushing or pulling the bag support system off the tracks. Slide stops 82 can be made unitary with the bag support tracks or as separate, but fixedly coupled, parts. Bag slide guides 64 and 66 are shown just beneath the upper slide stops.

Figure 9:
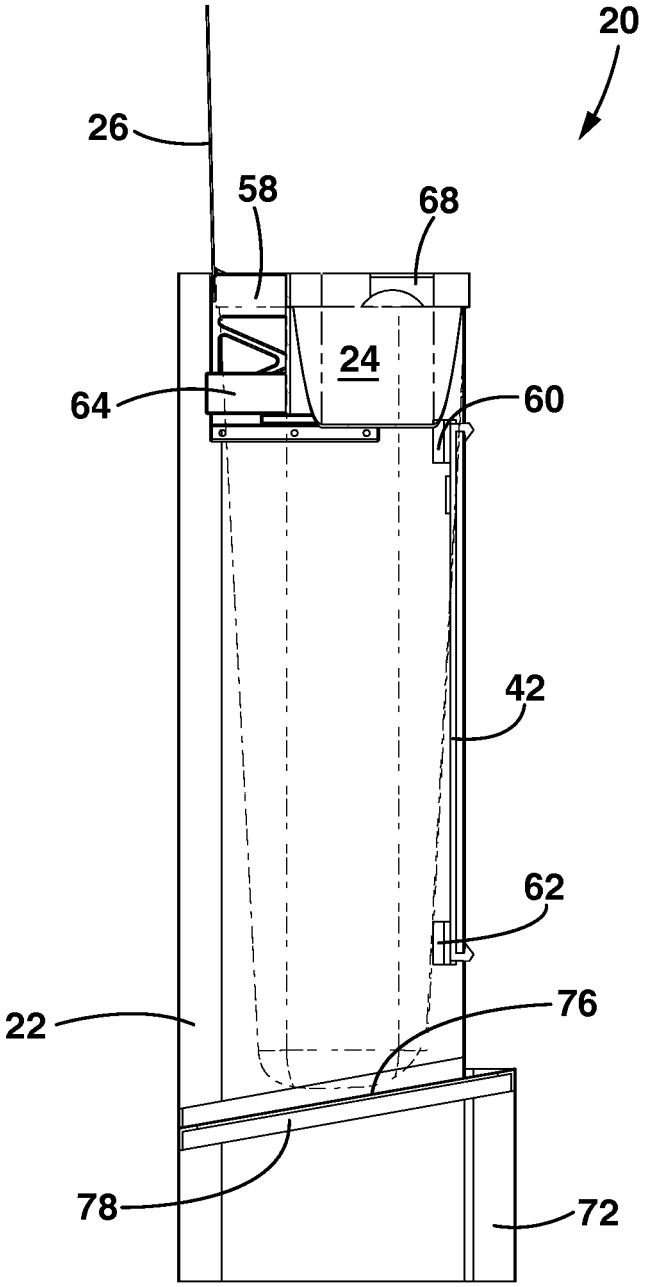
FIG. 9 is a section view taken from FIG. 2, along section line 9

From this perspective, one can see the two arms of the C shaped bag support bracket 68 reach generally from the back inner surface of the shell forward to the left and the right front upper corners of the shell. It is worth noting again that the bag support bracket does not reach around the front of the trash can. This allows a user to hang a trash bag in one smooth forward motion. A front segment to the bag support bracket would require a user to stoop or bend. Despite the bag support bracket missing a front segment, it nonetheless supports the weight of a full standard kitchen trash bag because of the tension created across the front opening of the trash bag. Bag slide guides 64 and 66 are fixedly mounted flush with a front lower edge of the corresponding arms of the bag support bracket. This attachment is shown in more detail in FIGS. 9 and 16.

Turning now to the lid lifting linkage system, a thin but rigid linkage 36 connects a center posterior edge of foot pedal 32 (not shown in this view) with lid 26. Linkage 36 runs substantially the vertical height of the trash can, along the back inner surface of the shell. A longitudinal linkage shield 52 fits over and covers the entire length of the linkage 36. Shield 52 is a hollow prism or cylinder of rigid material, with longitudinally running outward extensions. In a preferred embodiment, shelf bracket mounts known in the art are affixed to a back-facing longitudinal surface of each outward extension. A corresponding column of hooks 30 is affixed to or integral to back inner to enable the shield to be hung on the back inner shell when not in use. Alternatively, one could reverse this arrangement, placing hooks on the back faces of each of the two extensions and a pair of vertically oriented and parallel shelf bracket mounts on the inner shell.

Figure 7:
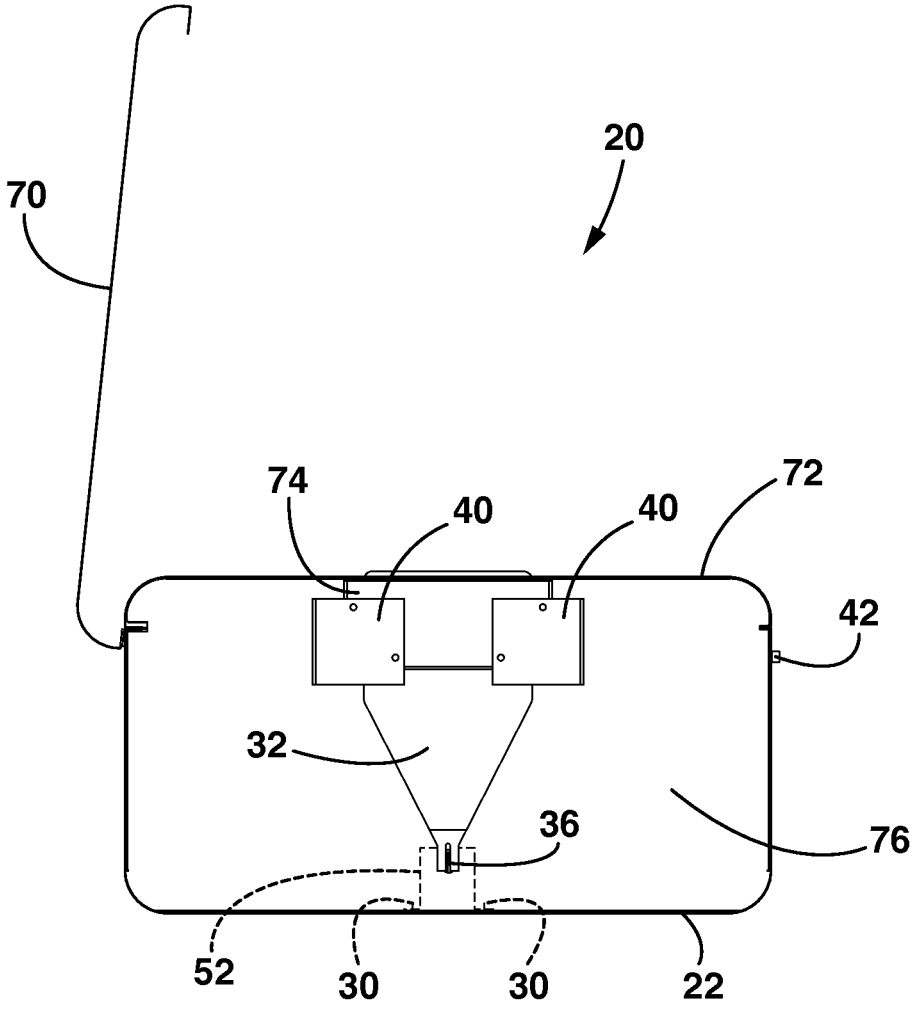
FIG. 7 is a bottom view thereof.

FIG. 7 shows foot pedal 32 floating above a pair of damper brackets 40 and about axle 28 (not numbered in this view) but below false bottom/catch pan 76. The pedal narrows posteriorly to almost a point. There, it is coupled to linkage 36. The linkage 36 passes through a small through hole (not shown or numbered in this view) in false bottom/catch pan 76 and behind linkage shield 56. The linkage shield does not pass through, but rather, ends at and is affixed flush to the false bottom/catch pan, concealing the through hole so that any liquid or solid debris does not leak therethrough.

Figure 8:
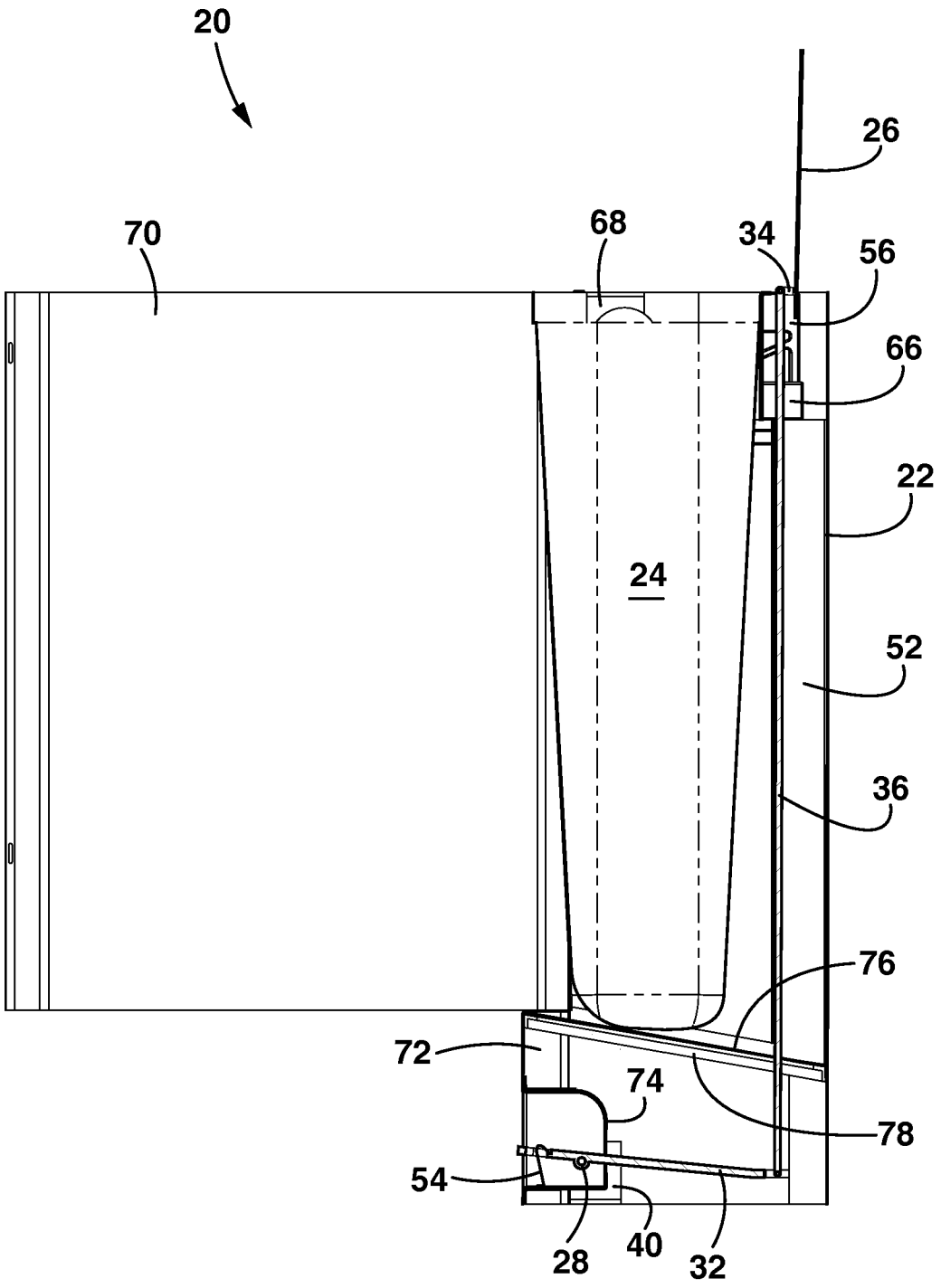
FIG. 8 is a section view taken from FIG. 2, along section line 8.

From the right side and the door open, in FIG. 8, one can see the false bottom/catch pan, pedal and lid lifting linkage systems in vertical relationship. The right side of the linkage shield 52 is cut away, showing the linkage 36 running parallel to and just within the boundaries of the shield. It can also be seen from this view that the linkage 36 runs through the false bottom/catch pan 76. Note in this view how false bottom/catch pan rests on supports 78 and slopes downward relative to the true floor.

Figure 10:
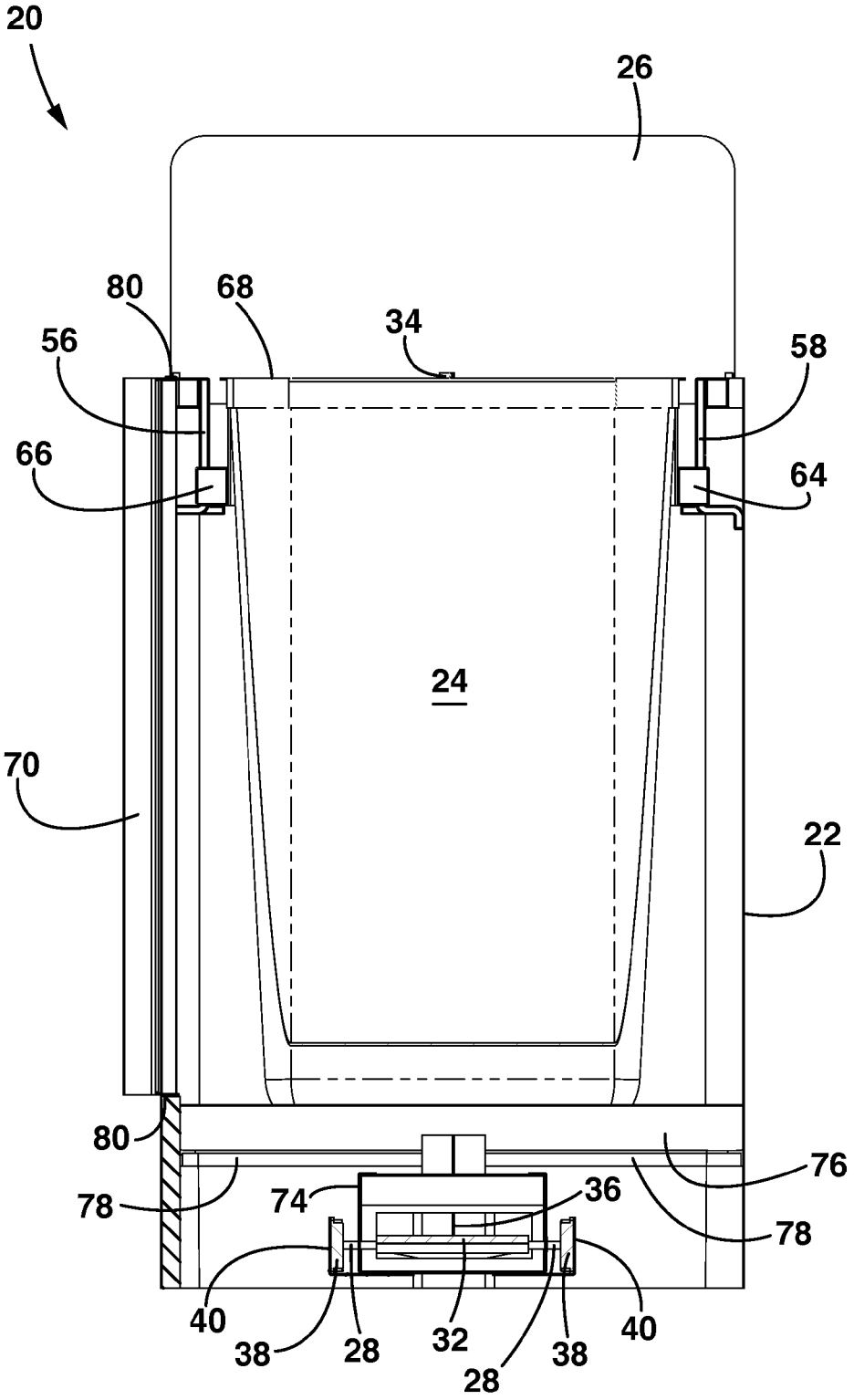
FIG. 10 is a section view taken from FIG. 5, along section line 10

To slow down the lid closing, it is necessary to add damping means. Because it is rotation of the pedal about the axle 28, it is necessary to select at least one rotational damper. In FIG. 10, one can see a pair of rotational viscous dampers 38 situated between the pedal housing 74 and the base 72 of the can. In a preferred embodiment, these are unidirectional rotational viscous dampers, such Model RN-K2 manufactured by Ace Controls. With a unidirectional rotational damper, only the lid closing motion is dampened. Alternatively, a single unidirectional rotational viscous damper can be used, such Ace Control's Model FDN. Axle 28 inserts tightly through the pedal such that pressing downward on the pedal rotates the axle. Each end of the axle extends through the corresponding side of the pedal housing into the cavity of the base and more specifically into a rotatable disc of the corresponding damper. A pair of damper brackets 40 is secured just beneath the pedal housing and behind the front of the base. The dampers themselves are affixed to the bracket so they do not shift up, down, left or right. Each end of the axle fits into the corresponding damper. The damper does not resist when the foot pedal is pressed, and the axle turns toward a user. The lid opens entirely on the power of a user's foot and linkage. Upon the lid falling, the axle turns away from a user. The damper now resists, and slows down the lid.

FIG. 12 shows from the right, with the door open how a user lifts the false bottom/catch pan out of the trash can. The linkage shield 52 doubles as a handle. Normally the linkage shield lies hidden behind a trash bag. Therefore, the only way to grab the linkage shield is to first remove the trash bag.

FIG. 13 is a close-up view of linkage 36 anchored to lid 26. L-shaped anchor 34 has one end fixedly mounted to lid 26 and the other end pivotally mounted to linkage 36. In this way when the linkage is urged upward, anchor 34 rotates roughly 90 degrees and pushes the lid open. Bag support bracket 68 and trash bag 24 sit spatially in front of, and do not interfere with the lid opening means.

FIG. 14 shows in detail a preferred method of attaching door 70 to shell 22 so that it closes flush with the shell. Hinge block 44 is mounted to and extends planarly from left shell 22. Left edge of door 70 is bent at roughly 90 degrees relative to the surface of the door. The bent edge has an extension at both the top and bottom. These extensions are bent at 90 degrees, parallel to the plane of the true floor. A hole in the top of these extensions allows pivot pins 80 to secure door 70 to hinge block 44 and the left shell.

FIG. 15 shows in detail lid 26 secured to shell (not numbered in this view) via lid pivot 46, lid pivot bracket 46 and pivot pin 50. The lid 26 is thus pivotally secured to both the left and right upper corners of the shell, although only the left is shown here for brevity and clarity. The lid pivot systems lie exteriorly to the bag support track 56. The lid can thus pivot freely and independently from the bag support system.

I claim:

1. A trash can, comprising:

a. a left shell, a right shell, a back shell connecting the left shell to the right shell from a topmost edge to a lowermost edge, a base positioned directly beneath the left shell, the right shell and the back shell and parallel to and substantially coplanar with and flush with the left shell, the right shell and the back shell, a front-opening door hingedly coupled to at least one of the left shell or the right shell, the front-opening door reaching from the topmost edge of the left and right shell to a topmost edge of the base, and a lid pivotally coupled to the back shell and dimensioned to cover the topmost edges of the left shell, the right shell and the front-opening door when the lid is closed;

b. a left bag support track and a right bag support track mounted to a corresponding upper, inner surface of the left and right shells;

c. a bag support bracket vertically slidable along the left and the right bag support tracks;

d. a pivoting pedal recessed within the base;

e. a thin and substantially rigid linkage connecting the pedal to the lid;

f. a false bottom/catch pan resting above the base and tilting lower toward the back shell;

g. a foot-operated lid-opening/stabilizing system coupled to the pedal;

h. a foot-operated lid-closing damper coupled to the pedal; and i. a linkage shield extending along substantially the entire length of the linkage, concealing the linkage and wherein the linkage shield is connected to the false bottom/catch pan.

2. The trash can of claim 1, wherein the left bag support track and the right bag support track retains the bag support bracket in position by friction fit.

3. The trash can of claim 2, wherein the trash bag support bracket retains a mouth of a trash bag hung thereon open and substantially parallel to a true floor without sagging.

4. The trash can of claim 3, wherein the left bag support track and the right bag support track bear vertical motion slide stops.

5. The trash can of claim 3, wherein the bag support bracket has a partial perimeter and a height and along the partial perimeter is substantially shaped to slide just within the space defined by the upper inner left shell, the upper inner back shell and the upper inner right shell.

6. The trash can of claim 5, wherein the bag support bracket is open as it faces the front-opening door; that is, it does not have a front connecting piece.

7. The trash can of claim 1, wherein the foot-operated lid opening/stabilizing system comprises a latch coupled to the pedal.

8. The trash can of claim 1, wherein the foot-operated lid-closing damper comprises at least one rotational viscous damper.

9. The trash can of claim 1, further comprising mechanical means to secure the front-opening door in a closed position.

10. A method of hanging and retaining trash bags in a trash can, comprising the steps of:

a. connecting a left shell to a back shell along a left edge of the back shell, connecting the back shell to a right shell along a right edge of the back shell, connecting a base below, parallel to, substantially coplanar to and flush with the so connected left shell, the back shell and the right shell, hingedly connecting a front-opening door to at least one front edge of the left shell or right shell, the front-opening door reaching from a topmost edge of the left shell and right shell to a topmost edge of the base, and pivotally connecting a lid to a back topmost edge of the back shell and dimensioned to cover the topmost edges of the left shell, the right shell and the front-opening door;

b. mounting a left bag support track and a right bag support track to a corresponding upper, inner surface of the left shell and the right shell;

c. inserting a bag support bracket to vertically slide within the left bag support track and the right bag support track;

d. installing a pivoting pedal within a recess of the base;

e. connecting the pedal to the lid with a thin and substantially rigid linkage;

f. resting a false bottom/catch pan directly above the base, this false bottom/catch pan tilting lower toward the back shell;

g. connecting a foot-operated lid opening/stabilizing system to the pedal;

h. connecting a foot-operated lid closing damper to the pedal;

i. concealing substantially the entire length of the linkage with a linkage shield; and j. connecting the linkage shield to the false bottom/catch pan.

11. The method of claim 10, further comprising opening the at least one front-opening door.

12. The method of claim 11, further comprising sliding the bag support bracket above the topmost edges of the left shell, the back shell, the right shell and the door.

13. The method of claim 12, further comprising stretching a mouth of a trash bag about the raised bag support bracket such that the bag hangs substantially parallel to a true floor.

14. The method of claim 10, further comprising selectively opening, stabilizing and closing the lid substantially using a foot.

15. The method of claim 10, further comprising dampening the lid closing substantially using a foot.

16. The method of claim 10, further comprising removing the false bottom/catch pan by grasping and the linkage shield then pulling the linkage shield through the front-opening door.

* * * * *